United States Patent [19]

Hujimori et al.

[11] 4,027,918

[45] June 7, 1977

[54] LONGWALL COAL MINING MACHINE WITH PLURAL CUTTERS ON SUB-RANGING ARM

[75] Inventors: Masao Hujimori; Shigeo Nakajima; Ken Takahashi, all of Tokyo; Tsunetoshi Ito; Toshio Shimada, both of Yokohama; Hajime Endo, Kushiro, all of Japan

[73] Assignee: Taiheiyo Engineering Incorporated, Tokyo, Japan

[22] Filed: Feb. 26, 1976

[21] Appl. No.: 661,578

[30] Foreign Application Priority Data

June 30, 1975 Japan ..... 50-80614

[52] U.S. Cl. ..... 299/53; 299/71; 299/80; 299/87

[51] Int. Cl.[2] ..... E21C 27/24

[58] Field of Search ..... 299/31, 43–54, 299/42, 55–61, 71, 80

[56] References Cited

UNITED STATES PATENTS

| | | | |
|---|---|---|---|
| 2,767,970 | 10/1956 | Paul | 299/53 X |
| 3,136,535 | 6/1964 | Lanfermann | 299/53 X |
| 3,639,004 | 2/1972 | Lockwood et al. | 299/59 X |
| 3,718,369 | 2/1973 | Anderson | 299/59 |
| 3,907,367 | 9/1975 | Nakajima | 299/53 |

*Primary Examiner*—Ernest R. Purser
*Attorney, Agent, or Firm*—Frank J. Jordan

[57] ABSTRACT

A coal mining machine intended to be used in a pit having a long-walled pit face and having a mechanism in which two cutting drums are attached to the main ranging arm of a ranging drum shearer through a sub-ranging arm and the position of said cutting drums is defined by the cooperation of said main- and sub-ranging arms.

8 Claims, 4 Drawing Figures

LONGWALL COAL MINING MACHINE WITH PLURAL CUTTERS ON SUB-RANGING ARM

BACKGROUND OF THE INVENTION a. Field of the invention

The present invention relates to an improvement of a ranging drum shearer which is used as a coal mining machine in a pit having a long-walled pit face and more particularly to a coal mining machine provided with a plurality of cutting drums interacting with one another so as to make it possible to adjust the range of coal mining height and therefore to easily attain a coal mining operation according to the change of a coal bed.

b. Description of the prior art

Conventional ranging drum shearers which have been used as a coal mining machine can be generally classified, according to the number of cutting drums provided, into a single ranging drum shearer having a ranging arm with a cutting drum provided at one end of the shearer and a double ranging drum shearer having a ranging arm with a cutting drum provided, respectively, at both ends of the shearer. However, these shearers of both types have the following disadvantages since they are limited in the outer diameter of their cutting drums from the viewpoint of mechanical strength.

In the case of the single ranging drum shearer provided with only one cutting drum, it is often that the pit face of a pit cannot be cut in one travel of the shearer, thus causing the shearer to be travelled forwards and backwards along the pit face, varying the position of the cutting drum in its level every forward and and backward travels. Further, since the cutting drum is provided only at one end of the shearer, the cutting operation cannot reach the foremost end of the pit face and therefore an additional operation such as hand cutting or the one by a different cutting machine is absolutely needed, thus lowering the efficiency of coal mining operation considerably.

On the other hand, in the case of the double ranging drum shearer, the cutting drums, each provided at both ends of the shearer respectively, are arranged with the one at an upper position and with the other at a lower position so that when the height of a coal bed is less than two times the outer diameter of a cutting drum, the coal bed can be perfectly cut in its whole level in one travel of the shearer. However, since the cutting drums are provided apart from each other at both ends of the shearer, only one travel of the shearer will leave the foremost end portion of the pit face not cut by either of the upper and lower cutting drums, thus making it necessary to again travel the shearer with the upper and lower cutting drums turned upside down, so as to cut the foremost end portion left. Further, when the floor of the coal bed is uneven, it is difficult for the double ranging drum shearer to attain a cutting operation keeping the coal mining height constant. Furthermore, since the height of the coal bed which can be cut by one travel of the shearer is limited to the sum of the outer diameters of two cutting drums and there is a limit in the outer diameter of the cutting drum as stated above, the coal bed having a height higher than the sum must be cut by the reciprocation of the shearer as in the case of the single ranging drum shearer or it is necessary to employ a blasting method or a method by which the coal mining operation is achieved at an upper and a lower pit faces respectively, thus resulting in an unsatisfactory efficiency of the coal mining operation. And furthermore, the operator of the shearer must always keep his eyes on the cutting drum cutting the floor side of the coal bed so that when the shearer is travelling windward, he is forced to work at the leeward side and in the coal dust, which is unhealthy to him as well as dangerous to his operation of the shearer, particularly when the coal dust is so thick as to make his visibility extremely worse. Water spraying intended to avoid this has not gained satisfactory effect.

SUMMARY OF THE INVENTION

The present invention is intended to eliminate the above-mentioned drawbacks which have been inherent to the conventional ranging drum shearers.

It is, therefore, a primary object of the present invention to provide a coal mining machine wherein a main ranging arm is provided with a sub-ranging arm to both ends of which are attached two cutting drums whereby the cutting height of the coal bed can be adjusted in a wide range according to the height of the coal bed.

Another object of the present invention is to provide a coal mining machine wherein when the height of the coal bed is less than the sum of the outer diameters of two cutting drums, the whole face of the coal bed can be cut by operating only two cutting drums, which are attached to one end of the shearer through the sub- and main-ranging arms, in one travel of the shearer and therefore the operator of the shearer can always work at the windward side.

Further object of the present invention is to provide a coal mining machine when the positions of the ranging arms are once determined, the cutting operation can be attained keeping the cutting height of the coal bed constant, even if the coal bed is curved.

Still further object of the present invention is to provide a coal mining machine wherein when there is present a hard portion such as rock in the coal bed, the hard portion can be crushed by a crushing roll which has been exchanged for at least one cutting drum while the other portion of the coal bed face can be cut by the other cutting drums in one travel of the shearer.

These and other object of the present invention will be apparent from the following detailed description with reference to the accompanying drawings.

DETAILED DESCRIPTION OF THE PREFERRED EMBODIMENT

Referring to FIGS. 1 through 4, there will be described an embodiment of the present invention.

Figure 1:
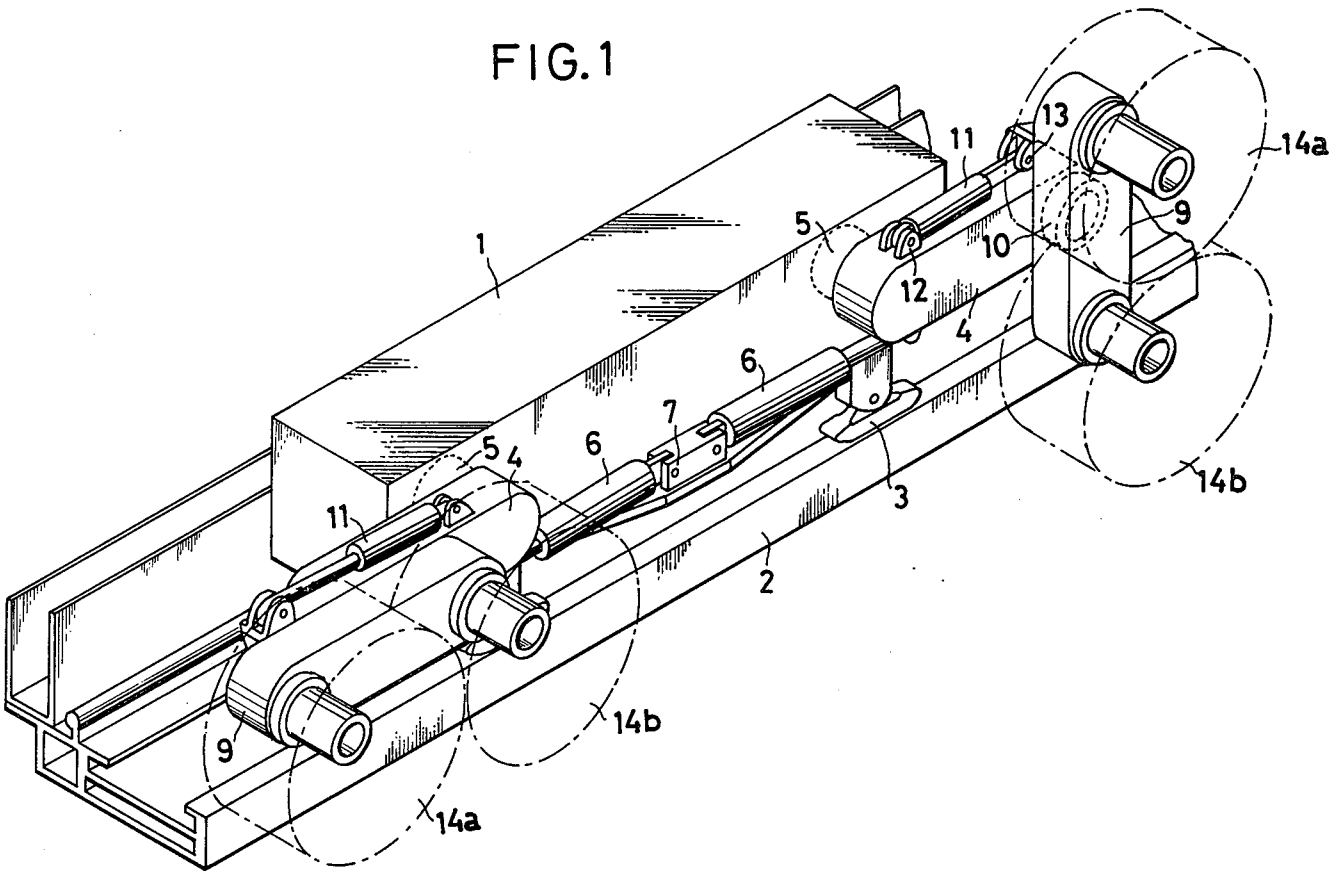
FIG. 1 is an isometric view showing an embodiment of the present invention.
Figure 2:
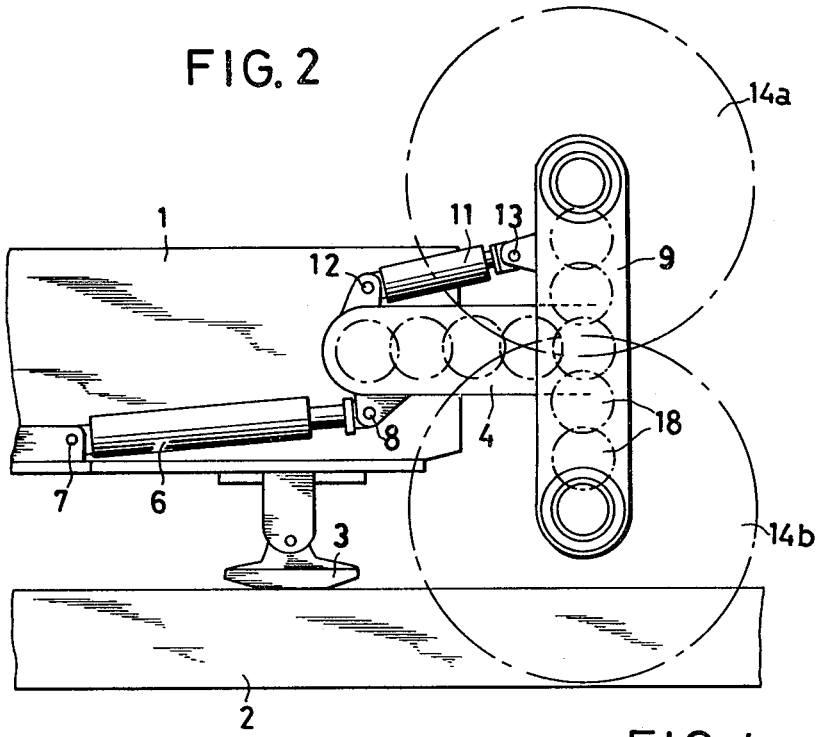
FIG. 2 is an elevation showing the main portion of ranging arms.

In FIG. 1 numeral 1 represents a double ranging drum shearer body containing a driving mechanism and being mounted on a conveyor 2 through skids 3. Numeral 4 denotes ranging arms whose end stems 5 are attached to both ends of the shearer body 1, respectively, and numeral 6 ranging jacks to rotate the ranging arms 4, the one end of each ranging jack 6 being attached to the shearer body 1 through a pin 7 and the other end thereof to the ranging arm 4 through a pin 8. Numeral 9 represents sub-ranging arms, each of which is mounted onto another circular end stem 10 projecting from the other end of the ranging arm 4, and numeral 11 sub-ranging jacks to rotate the sub-ranging arms 9, the one end of each sub-ranging jack 11 being attached to one end of the ranging arm 4 through a pin 12 and the other end thereof to the sub-ranging arm 9 through a pin 13. Numerals 14*a* and 14*b* represent cutting drums freely rotatably attached to both ends of the sub-ranging arm 9, and cutting picks 17 are attached to the outer circumferences of herical fins 15 and to the surfaces of end plates 16 arranged at the front faces of the cutting drums. Numeral 18 represents a power transmission mechanism consisting of gears or the like contained in the main- and sub-ranging arms, said power transmission mechanism being intended to synchronously rotate two cutting drums attached to both ends of the sub-ranging arm. Both of the cutting drums 14*a* and 14*b* may be rotated either in same direction or in reverse directions.

Figure 3:
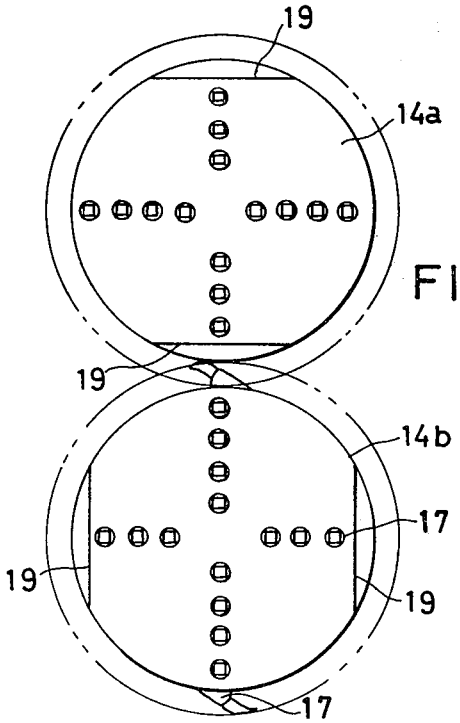
FIG. 3 is an elevation of a drum shearer.
Figure 4:
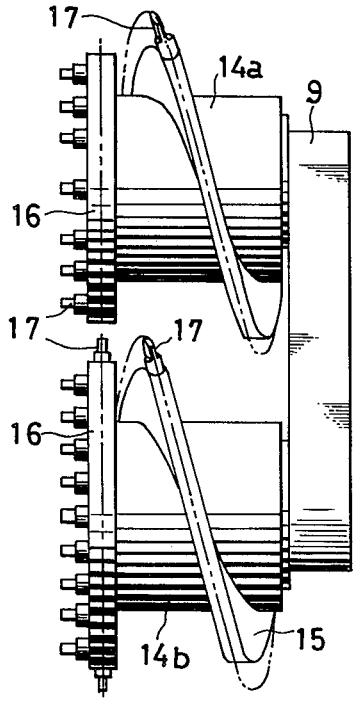
FIG. 4 is a side view of the drum shearer.

It is arranged in the present invention that the helical fin 15 and the picks 17 of the cutting drum 14*a* do not come into interference with those of the other cutting drum 14*b* at that time of rotation of these cutting drums 14*a* and 14*b*. As shown in FIGS. 3 and 4, two helical fins 15 are shifted in position and a pair of notched portions 19, opposite to each other, of the end plate 16 are also shifted in position from those of the other end plate 16. The construction of the cutting drums is not limited to the one as shown in FIGS. 3 and 4 and may be any one in which the helical fins and the picks of two cutting drums are not brought into interference, respectively. The arrangement of the picks 17 may be optionally selected.

The coal mining machine of the present invention having such construction as described above is operated as follows:

According to the height of a coal bed having a long-walled pit face, the cutting drums 14*a* and 14*b* are positioned in such a manner the the main- and sub-ranging jacks 6 and 11 are operated to locate the ranging arms 4 in vertical direction and the sub-ranging arms 9; the driving mechanism is then operated to travel the shearer body 1 along on the conveyor 2 and at the same time the power transmission mechanism 18 is rendered operative to synchronously rotate the cutting drums 14*a* and 14*b*; and keeping his eyes on the lower cutting drums 14*b*, the operator of the machine operates the main- and sub-ranging arms to allow the lower cutting drums to move along the floor of the coal bed, so that the cutting drums 14*a* and 14*b*, rotating, are pressed onto the face of the coal bed to be cut, thus causing the picks 17 thereof to attain their cutting operation.

When the height of the coal bed is less than the sum of the outer diameters of two cutting drums 14*a* and 14*b*, two cutting drums attached to the one of the ranging arms are kept inoperative while those attached to the other of the ranging arms are operated. In this case, when the position of the sub-ranging arm 9 is once determined according to the height of the coal bed, the cutting operation can be achieved keeping the cutting height constant only by operating the ranging arm 4 so as to travel the lower cutting drum 14*b* along the floor of the coal bed.

When the height of the coal bed is more than the sum of the outer diameters of two cutting drums 14*a* and 14*b*, respective two cutting drums attached to both of the main ranging arms are rendered operative. In this case, four cutting drums are positioned so as to cut the whole face of the coal bed by raising the front ranging arm and lowering the back ranging arm while operating the sub-ranging arms.

In case the height of the coal bed is more than the sum of the outer diameters of four cutting drums, the shearer body may be reciprocated as in the conventional mining operation.

Another embodiment of the present invention is intended to be used when there is present a hard portion in the coal bed. Namely, this embodiment is constructed so as to allow at least one of the cutting drums to be exchanged with a crushing roll for crushing the hard portion present in the coal bed. In this case, the shearer body is operated in such a manner that the lower cutting drum of the front sub-ranging arm is exchanged with the crushing roll, which is arranged to follow the other upper cutting drum by operating the sub-ranging arm, and that the front main-ranging arm is located at the floor side of the coal bed while the back main-ranging arm at the upper side thereof. As a result, the cutting drum of the front sub-ranging arm and the upper cutting drum of the back sub-ranging arm cut under and above the hard portion the face of the coal bed while the crushing roll easily crushes the hard portion left, thus enabling the whole face of the coal bed to be cut in one travel of the shearer body.

The present invention enables any other optional coal mining methods to be attained, for example, a twice cutting operation to be attained at the floor side of the coal bed with the cutting height kept constant when the height of the coal bed is less than the sum of the outer diameters of two cutting drums.

The present invention has been described in detail with reference to the double ranging drum shearer to which the present invention is applied, but the present invention can be applied to the single ranging drum shearer, or to the cutting drum section arranged at the one end of the conventional double ranging drum shearer body.

It is most preferable in the present invention that the area and the height of the coal bed to be cut by the cutting drums 14*a* and 14*b* can be adjusted twice by arranging the sub-ranging arms 9 to be freely rotated relative to the main ranging arms 4 and by also arranging the main ranging arms 4 to be freely rotated relative to the shearer body. It may be arranged that either of the main- or sub-ranging arms are fixed. It may be also arranged that one or more cutting drums are located between two cutting drums 14*a* and 14*b* under the condition that the helical fins and the picks thereof are not brought into interference with one another. Or, two cutting drums 14*a* and 14*b* which are to be attached to both ends of the sub-ranging arm may be arranged apart from each other.

According to the present invention, at least one of the main ranging arms of the conventional ranging drum shearer is provided with a sub-ranging arm and to both ends of the sub-ranging arm are attached two cutting drums, so that when the height of the coal bed is less than the sum of the outer diameters of two cutting drums, the whole face of the coal bed can be cut with the cutting height kept constant in one travel of the shearer, even if the floor of the coal bed is uneven. Further, in case the present invention is applied to the double ranging drum shearer, the cutting operation of the coal bed of which height is less than the sum of the outer diameters of two cutting drums can be attained only by rendering two cutting drums operative, thus enabling the operator of the shearer to work at the windward side. Furthermore, the area and the height of the coal bed to be cut in one travel of the shearer of the present invention are so large that the efficiency of the coal mining operation can be more considerably enhanced than that in the conventional shearers. And furthermore, the arrangement of attaching two cutting drums to both ends of the shearer body, respectively, enables a variety of efficient coal mining methods to be employed.

What is claimed is:

1. A coal mining machine for use in a pit having a longwalled pit face comprising a shearer body, a main ranging arm having one end portion thereof pivotally mounted on said shearer body, a ranging jack operatively connected between said shearer body and said main ranging arm for pivoting the latter relative to said shearer body, a sub-ranging arm having an intermediate portion and two end portions, means pivotally mounting said intermediate portion of said sub-ranging arm to the other end portion of said main ranging arm, a sub-ranging jack operatively connected between said main ranging arm and said sub-ranging arm for pivoting the latter relative to said main ranging arm, said sub-ranging arm being pivotal between a first position generally parallel to said main ranging arm and a second position generally perpendicular to said main ranging arm, drum means rotatably mounted on said two end portions of said sub-ranging arm such that when sub-ranging arm is in said first position, said coal mining machine is operable to effect cutting along a height substantially equivalent to the diameter of one of said drums and when said sub-ranging arm is in said second position, said mining machine is operable to effect cutting along a height substantially equivalent to the sum of the diameter of said two drums.

2. A coal mining machine according to claim 1 wherein said shearer body has a first and a second end section, said main ranging arm being pivotally mounted on said first end section of said shearer body, a second main ranging arm having one end portion thereof pivotally mounted on said second end section of said shearer body, a second ranging jack operatively connected between said shearer body and said second main ranging arm for pivoting the latter relative to said shearer body, a second sub-ranging arm having an intermediate portion and two end portions, means pivotally mounting said intermediate portion of said second sub-ranging arm to the other end portion of said second main ranging arm, a second sub-ranging jack operatively connected between said second main ranging arm and said second sub-ranging arm for pivoting the latter relative to said second main ranging arm, said second sub-ranging arm being pivotal between a first position generally parallel to said second main ranging arm and a second position generally perpendicular to said second main ranging arm, drum means rotatably mounted on said two end portions of said second sub-ranging arm, the first said main ranging arm and said second main ranging arm being pivotal to operable positions such that when the first said sub-ranging arm and said second sub-ranging arm are each in their second positions, said mining machine is operable to effect cutting along a height substantially equivalent to the sum of the diameter of said four drums.

3. A coal mining machine according to claim 2 whereby in said operable positions of the first said main ranging arm and said second main ranging arm, the first said main ranging arm is pivoted to an elevated position extending above the longitudinal axis of said shearer body and said second main ranging arm is pivoted to a depressed position extending below the longitudinal axis of said shearer body.

4. A coal mining machine according to claim 2 wherein said shearer body is movable longitudinally along a conveyor, said shearer body being generally horizontally disposed during operation of said mining machine, the first said sub-ranging arm and said second sub-ranging arm when in said first position being generally horizontally disposed and when in said second position being generally vertically disposed.

5. A coal mining machine according to claim 1 wherein said drums comprise cutting elements.

6. A coal mining machine according to claim 1 wherein at least one of said drums comprises a crushing roll.

7. A coal mining machine according to claim 1 wherein drive means are included in said main ranging arm and in said sub-ranging arm for driving said drums.

8. A coal mining machine according to claim 7 wherein said drive means are gears.

* * * * *